US007731477B2

(12) United States Patent
Erni

(10) Patent No.: US 7,731,477 B2
(45) Date of Patent: Jun. 8, 2010

(54) INSULATED HOUSING APPARATUS FOR USE WITH AN ATTIC FAN

(76) Inventor: Thomas W. Erni, 19 Galloping Brook Rd., Allentown, NJ (US) 08501

( * ) Notice: Subject to any disclaimer, the term of this patent is extended or adjusted under 35 U.S.C. 154(b) by 704 days.

(21) Appl. No.: 11/653,041

(22) Filed: Jan. 12, 2007

(65) Prior Publication Data

US 2007/0178827 A1 Aug. 2, 2007

Related U.S. Application Data

(60) Provisional application No. 60/760,874, filed on Jan. 23, 2006.

(51) Int. Cl.
*F04D 29/52* (2006.01)

(52) U.S. Cl. ..... 415/126; 415/177; 415/211.2; 415/220

(58) Field of Classification Search ..... 415/126, 415/128, 220, 177, 211.2; 454/252, 242, 454/253, 347, 239, 259; 137/601.01
See application file for complete search history.

(56) References Cited

U.S. PATENT DOCUMENTS

| | | | |
|---|---|---|---|
| 2,314,003 | A | 3/1943 | Mader |
| 2,464,000 | A | 3/1949 | Schild |
| 2,483,547 | A | 10/1949 | Koch |
| 2,599,075 | A | 6/1952 | Stroup |
| 2,673,514 | A | 3/1954 | Hanks |
| 2,687,687 | A | 8/1954 | Prudhon |
| 2,800,853 | A | 7/1957 | Spear |
| 3,012,495 | A | 12/1961 | Miller |
| 3,058,491 | A | 10/1962 | Myhre |
| 3,123,098 | A | 3/1964 | Bishop |
| 3,232,205 | A | 2/1966 | Bumstead |
| 3,401,624 | A | 9/1968 | Mohrman |
| 3,559,560 | A | 2/1971 | Trahan |
| 3,677,517 | A | 7/1972 | Root et al. |
| 3,907,050 | A | 9/1975 | Mullings |
| 3,964,377 | A | 6/1976 | Chapman |
| 4,006,672 | A | 2/1977 | Matsuyoshi et al. |
| 4,073,597 | A | 2/1978 | Barnhart et al. |
| 4,094,336 | A | 6/1978 | Urschel |
| 4,106,399 | A | 8/1978 | Lawrence, Jr. |
| 4,131,060 | A | 12/1978 | Caine |
| 4,281,743 | A | 8/1981 | Fuller |
| 4,372,196 | A | 2/1983 | Henderson |
| 4,406,216 | A | 9/1983 | Hott et al. |
| 4,445,426 | A | 5/1984 | Bohanon, Sr. |
| 4,457,215 | A | 7/1984 | Vogt |
| 4,469,018 | A | 9/1984 | Taulman |

(Continued)

*Primary Examiner*—Ninh H Nguyen
(74) *Attorney, Agent, or Firm*—Sperry, Zoda & Kane

(57) ABSTRACT

An insulated enclosure apparatus for use with an exhaust fan such as an attic fan which includes an upper frame through which air can exhaust and a lower frame for receiving air passing thereinto. The outer portion of the frame includes an upper frame and the lower frame that are each formed as two-piece units. Vertically extending panels extending therebetween to house the fan. A pivot axle is attached to the undersurface of each of the two doors for facilitating automatic opening and closing responsive to whether the fan is operating. Limit pins are included to restricted the distance of movement of the doors when opened. Gaskets can be attached along the door edges for sealing thereof to the upper frame.

20 Claims, 4 Drawing Sheets

U.S. PATENT DOCUMENTS

| | | | |
|---|---|---|---|
| 4,501,194 | A | 2/1985 | Brown |
| 4,502,368 | A | 3/1985 | Hempel |
| 4,735,132 | A | 4/1988 | Ching |
| 4,823,679 | A | 4/1989 | Robbins |
| 4,858,520 | A | 8/1989 | Prochnow et al. |
| 4,886,415 | A | 12/1989 | Engelberger et al. |
| 4,951,728 | A | 8/1990 | Takano |
| 5,060,901 | A | 10/1991 | Lathrop et al. |
| 5,330,386 | A | 7/1994 | Calandra |
| 5,538,074 | A | 7/1996 | Meyer |
| 5,609,522 | A | 3/1997 | Szwartz |
| 5,755,069 | A | 5/1998 | Sullivan |
| 5,800,259 | A | 9/1998 | Olney |
| 5,921,862 | A | 7/1999 | Ucciardi |
| 5,987,836 | A | 11/1999 | Sullivan |
| 6,050,893 | A | 4/2000 | Waite |
| 6,149,698 | A | 11/2000 | Uehara |
| 6,213,117 | B1 | 4/2001 | Kirk et al. |
| 6,261,175 | B1 | 7/2001 | Larson et al. |
| 6,267,667 | B1 | 7/2001 | Fikes |
| 6,439,466 | B2 | 8/2002 | Fikes |
| 6,488,579 | B2 | 12/2002 | Larson et al. |
| 6,533,656 | B2 | 3/2003 | Hertel |
| 6,599,183 | B1 | 7/2003 | Barber |
| 6,601,352 | B1 | 8/2003 | Obermeyer et al. |
| 6,616,404 | B1 | 9/2003 | Davis et al. |
| 6,643,130 | B1 | 11/2003 | DeMarchis et al. |
| 6,685,557 | B1 | 2/2004 | Hoffe |
| 6,767,279 | B1 | 7/2004 | Serrano |
| 6,802,770 | B2 | 10/2004 | Larson et al. |
| 6,837,785 | B2 | 1/2005 | Soderlund |
| 6,863,258 | B2 | 3/2005 | Tupis |
| 6,887,149 | B2 | 5/2005 | Palmer et al. |
| 6,915,799 | B2 | 7/2005 | Weiss |

INSULATED HOUSING APPARATUS FOR USE WITH AN ATTIC FAN

The present application for utility patent application hereby formally claims priority of U.S. Provisional Patent application No. 60/760,874 filed Jan. 23, 2006 on "ATTIC FAN INSULATED ENCLOSURE APPARATUS" filed by the same inventor listed herein, namely, Thomas W. Erni, and this referenced provision application is hereby formally incorporated by reference as an integral part of the present application.

BACKGROUND OF THE INVENTION

1. Field of the Invention

The disclosed concept relates to the construction of a housing adapted to be positioned around fans such as attic fans for insulating thereof from the external environment at times when the fan is not being utilized. These designs are useful for preventing the loss of heat through these openings during times of the year and times of the day during which the fan itself is not operating. The doors are adapted to open to allow air flow through the insulation device responsive to actuation of the fans.

Such attic fans are normally installed in a horizontally oriented plane at a central location within the house for allowing warm air to be drawn upwardly therethrough for exhausting outwardly to cool the house especially during periods of warm weather. An opening is made in the uppermost ceiling of the upper floor of the house to facilitate this flow of air.

2. Description of the Prior Art

A number of devices have been patented to be usable for insulating such attic-type fan designs such as U.S. Pat. No. 2,314,003 patented Mar. 16, 1943 to E. A. Mader and assigned one-half to John Spargo on a "Counterbalanced Louver Construction"; and U.S. Pat. No. 2,464,000 patented Mar. 8, 1949 to A. W. Schild on a "Louver Mechanism For Attic Ventilation"; and U.S. Pat. No. 2,483,547 patented Oct. 4, 1949 to J. B. Koch and assigned to American Blower Corporation on a "Built-In Ventilator"; and U.S. Pat. No. 2,599,075 patented Jun. 3, 1952 to D. H. Stroup on a "Closure Element For Air Ducts"; and U.S. Pat. No. 2,673,514 patented Mar. 30, 1954 to E. N. Hanks on a "Suction Controlled Louver"; and U.S. Pat. No. 2,687,687 patented Aug. 31, 1954 to C. Prudhon and assigned to Pruden Products Co. on a "Back Draft Damper For Exhaust Fans"; and U.S. Pat. No. 2,800,853 patented Jul. 30, 1957 to W. A. Spear and assigned to NuTone, Inc. on an "Automatic Shutter For Ventilators"; and U.S. Pat. No. 3,012,495 patented Dec. 12, 1961 to B. H. Miller and assigned to Genie-Air, Inc. on a "Combined Air Dampener And Air Diverter"; and U.S. Pat. No. 3,058,491 patented Oct. 16, 1962 to. T. K. Myhre on an "Arrangement For Pressure-Controlled Quantity Regulation In Air Ventilation Installations"; and U.S. Pat. No. 3,123,098 patented Mar. 3, 1964 to R. H. Bishop on a "Multiple Louver Damper"; and U.S. Pat. No. 3,232,205 patented Feb. 1, 1966 to A. D. Bumstead on an "Attic Ventilating System With Cover Means"; and U.S. Pat. No. 3,401,624 patented Sep. 17, 1968 to H. L. Mohrman and assigned to Allied Thermal Corporation on an "Air Exhauster With Damper means"; and U.S. Pat. No. 3,559,560 patented Feb. 2, 1971 to W. R. Trahan and assigned to Texfan, Inc. on "Ceiling Boxes For Distributing Air"; and U.S. Pat. No. 3,677,517 patented Jul. 18, 1972 to J. R. Root et al and assigned to Ruskin Manufacturing Company on a "Wrap-Around Damper Frame"; and U.S. Pat. No. 3,907,050 patented Sep. 23, 1975 to D. M. Mullings and assigned to General Electric Company on a "Heat Exchanger Housing"; and U.S. Pat. No. 3,964,377 patented Jun. 22, 1976 to L. O. Chapman on "Insulated Closures For Attic Fans, And Seals Therefor"; and U.S. Pat. No. 4,006,672 patented Feb. 8, 1977 to M. Matsuyoshi et al and assigned to Matsushita Seilo Co., Ltd. on a "Ventilation Fan (Ventilation System)"; and U.S. Pat. No. 4,073,597 patented Feb. 14, 1978 to D. A. Barnhart et al and assigned to The Celotex Corporation on a "Fan Housing Assembly"; and U.S. Pat. No. 4,094,336 patented Jun. 13, 1978 to J. N. Urachel on a "Back Draft For Exhaust Fans And Hoods"; and U.S. Pat. No. 4,106,399 patented Aug. 15, 1978 to G. C. Lawrence, Jr. on a "Vehicle Roof Ventilator Insulation Covering"; and U.S. Pat. No. 4,131,060 patented Dec. 26, 1978 to M. A. Caine and assigned to The Crest Company on a "Self-Closing Exhaust Fan Cover"; and U.S. Pat. No. 4,281,743 patented Aug. 4, 1981 to G. C. Fuller on an "Insulating Enclosure For Disappearing Stairway"; and U.S. Pat. No. 4,372,196 patented Feb. 8, 1983 to D. L. Henderson on an "Insulating And Draft Preventing Automatic Shutter For Attic And Other Exhaust Type Fans"; and U.S. Pat. No. 4,406,216 patented Sep. 27, 1983 to. W. M. Hott et al and assigned to Philips Industries, Inc. on a "Ventilator Device And Mounting Arrangement Therefor"; and U.S. Pat. No. 4,445,426 patented May 1, 1984 to. H. R. Bohanon, Sr. and assigned to Acme Engineering & Manufacturing Corporation on a "Slanted Housing Fan Enclosure"; and U.S. Pat. No. 4,457,215 patented Jul. 3, 1984 to E. H. Yogt on a "Duct Air Cover"; and U.S. Pat. No. 4,469,018 patented Sep. 4, 1984 to N. W. Taulman on an "Energy-Saving Closure For Foundation Vents"; and U.S. Pat. No. 4,501,194 patented Feb. 26, 1985 to. W. J. Brown and assigned to Emerson Electric Co. on a "Whole House Attic Fan"; and U.S. Pat. No. 4,502,368 patented Mar. 5, 1985 to G. T. Hempel on an "Air Vent Cover"; and U.S. Pat. No. 4,735,132 patented Apr. 5, 1988 to K. T. Ching on an "Insulating Enclosure For Recessed Ceiling Exhaust Fan"; and U.S. Pat. No. 4,823,679 patented Apr. 25, 1989 to R. R. Robbins on a "Building Ventilation System With Air Inlet Flap Control"; and U.S. Pat. No. 4,858,520 patented Aug. 22, 1989 to K. E. Prochnow et al and assigned to Carnes Company, Inc. on an "Auxiliary Frame For Ceiling Mounted Air Diffusers And The Like"; and U.S. Pat. No. 4,886,415 patented Dec. 12, 1989 to R. Engelberger et al and assigned to Papst-Motoren GmbH on a "Fan With An Essentially Square Housing"; and U.S. Pat. No. 4,951,728 patented Aug. 28, 1990 to K. Takano on a "Louver Device Formed By Sheet-Like Material"; and U.S. Pat. No. 5,060,901 patented Oct. 29, 1991 to D. R. Lathrop et al and assigned to Emerson Electric Co. on a "Whole House Fan"; and U.S. Pat. No. 5,330,386 patented Jul. 19, 1994 to T. P. Calandra on a "Method And Device For Ventilating A Home"; and U.S. Pat. No. 5,538,074 patented to F. Meyer on Jul. 23, 1996 on a "Heat Exchanger, In Particular Cooling Apparatus"; and U.S. Pat. No. 5,609,522 patented Mar. 11, 1997 to H. S. Szwartz on a "Combination Damper And Chimney Cap Apparatus"; and U.S. Pat. No. 5,755,069 patented May 26, 1998 to D. Sullivan and assigned to Specialty Metal Fabrication, Inc. on a "Louver Assembly And Method For Installing A Louver Assembly"; and U.S. Pat. No. 5,800,259 patented Sep. 1, 1998 to J. R. Olney and assigned to B & B Molders, L.L.C. on a "Grill Assembly"; and U.S. Pat. No. 5,921,862 patented Jul. 13, 1999 to F. J. Ucciardi and assigned to Consol, Inc. on an "Air Flow Reversal Prevention Door Assembly"; and U.S. Pat. No. 5,987,836 patented Nov. 23, 1999 to D. Sullivan and assigned to Specialty Metal Fabrications, Inc. on a "Louver Assembly And Method For Installing A Louver Assembly"; and U.S. Pat. No. 6,050,893 patented Apr. 18, 2000 to D. R. Waite on a "Cover For An Attic Fan Vent"; and U.S. Pat. No. 6,149,698 patented Nov. 21, 2000 to K. Uehara on an "Apparatus For Installing A Ventilation Fan"; and U.S. Pat. No. 6,213,117 patented Apr. 10, 2001 to W. M. Kirk et al and assigned to Board of Regents of University of Nebraska on a "Motorized Insulated Damper Assembly For Furnace Systems"; and U.S. Pat. No. 6,261,175 patented Jul. 17, 2001 to D. M. Larson et al and assigned to Broan-Nutone LLC on a "Ventilating Exhaust Fan"; and U.S. Pat. No. 6,267,667 patented Jul. 31, 2001 to J. D. Fikes on an "Air Duct Evacuation System"; and U.S. Pat. No. 6,439,466 patented Aug. 27, 2002 to J. D. Fikes on a "Climate Control System"; and U.S. Pat. No. 6,488,579 patented Dec. 3, 2002 to D. M. Larson et al and assigned to Broan-Nutone LLC on a "Ventilating Exhaust Fan"; and U.S. Pat. No. 6,533,656 patented Mar. 18, 2003 to P. H. Hertel on an "Air Handling System Duct Closure And Heat Trap"; and U.S. Pat. No. 6,601,352 patented Aug. 5, 2003 to K. G. Obermeyer et al and assigned to Ado, Inc. on an "Insulated Attic Access Cover"; and U.S. Pat. No. 6,616,404 patented Sep. 9, 2003 to J. R. Davis et al and assigned to Munters Corporation on a "Ventilation Fan"; and U.S. Pat. No. 6,599,183 patented Jul. 29, 2003 to G. A. Barber on a "Shutter Assembly For An Intake Opening In An Exhaust Fan"; and U.S. Pat. No. 6,643,130 patented Nov. 4, 2003 to J. A. DeMarchis et al on a "Wash Down Filtered Fan Apparatus"; and U.S. Pat. No. 6,685,557 patented Feb. 3, 2004 to D. Hoffe on a "Building Ventilation Air Inlet Assembly"; and U.S. Pat. No. 6,767,279 patented Jul. 27, 2004 to R. Serrano on a "Ceiling Vent Assembly"; and U.S. Pat. No. 6,802,770 patented Oct. 12, 2004 to D. M. Larson et al and assigned to Broan-Nutone LLC on a "Ventilating Exhaust Fan"; and U.S. Pat. No. 6,837,785 patented Jan. 4, 2005 to P. T. Solderlund and assigned to Telefonaktiebolaget LM EDricsson on a "Check Valve, Fan Unit, And Forced Air Cooling System"; and U.S. Pat. No. 6,863,258 patented Mar. 8, 2005 to J. A. Tupis and assigned to General Electric Company on a "Sealed Damper Assembly"; and U.S. Pat. No. 6,887,149 patented May 3, 2005 to R. C. Palmer et al and assigned to AdobeAir, Inc. on a "Cooling System With Mesch Grill And Directional Louvers"; and U.S. Pat. No. 6,915,799 patented Jul. 12, 2005 to C. A. Weiss and assigned to Flue Sentinel, Inc. on a "Damper Control Device For Outside Applications".

SUMMARY OF THE INVENTION

The apparatus of the present invention is usable to define an enclosure which will define a chamber means therewithin for enclosing and selectively sealing of a fan, such as a large attic or exhaust fan, positioned in the upper areas of the upper floor in the ceilings of many houses. Such fans are commonly used in the summer and the present apparatus provides a means for automatically sealing the outlet opening defined for the fan whenever the fan is not in use.

This enclosure includes a unique double frame configuration including an upper frame and a lower frame each formed as two separate parts which can be detached to allow the apparatus to be collapsible into a compact form to facilitate shipment, movement or other repositioning thereof. The upper frame preferably includes two separate upper members engageable with respect to one another. Four panels extend vertically in a generally rectangular or square configuration between an upper frame and a similarly configured lower frame.

The upper frame includes two pivotally movable doors which are biased into the closed position whenever the fan is not operating but which can be moved to the opened position responsive to the flow and movement of air against the planar surfaces of these members.

Each door is pivotally movable and is a mirror image of one another and includes an axle secured through eyelets to the lower surface thereof. The axle is defined to extend through holes defined in the upper frame to facilitate pivotal movement of the doors between the closed position insulating the house and the opened position responsive to actuation of the fan positioned therewithin.

The axles are preferably suspended by an eyelet pin configuration which is held in place and includes a limit pin extending outwardly therefrom to limit movement of the doors to the opened position. These pins limit the path of movement of the doors away from the closed position toward the opened position by abutting the upper edges of the four panel members. By limiting this movement towards the opened position the doors will be allowed to automatically return to the closed position responsive to cessation of operation of the fan itself.

It is an object of the present invention to provide an attic fan insulated enclosure apparatus which saves heating and cooling expenses.

It is an object of the present invention to provide an attic fan insulated enclosure apparatus which is an energy saving device.

It is an object of the present invention to provide an attic fan insulated enclosure apparatus which can insulate a fan designed to ventilate an entire house.

It is an object of the present invention to provide an attic fan insulated enclosure apparatus which automatically winterizes.

It is an object of the present invention to provide an attic fan insulated enclosure apparatus which acts like a storm door or window when the fan is not used in the winter.

It is an object of the present invention to provide an attic fan insulated enclosure apparatus which helps trap air and cuts down on cold added air from filtering down pass the fan that helps a building stay warmer and reduces fuel bills thereof.

It is an object of the present invention to provide an attic fan insulated enclosure apparatus which is usable with any normally sized fan of thirty inches or less.

It is an object of the present invention to provide an attic fan insulated enclosure apparatus which eliminates the need to climb ladders to cover and uncover shutters for the winter.

It is an object of the present invention to provide an attic fan insulated enclosure apparatus which uses plastic or other materials to stop cold air from filtering pass the fan.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
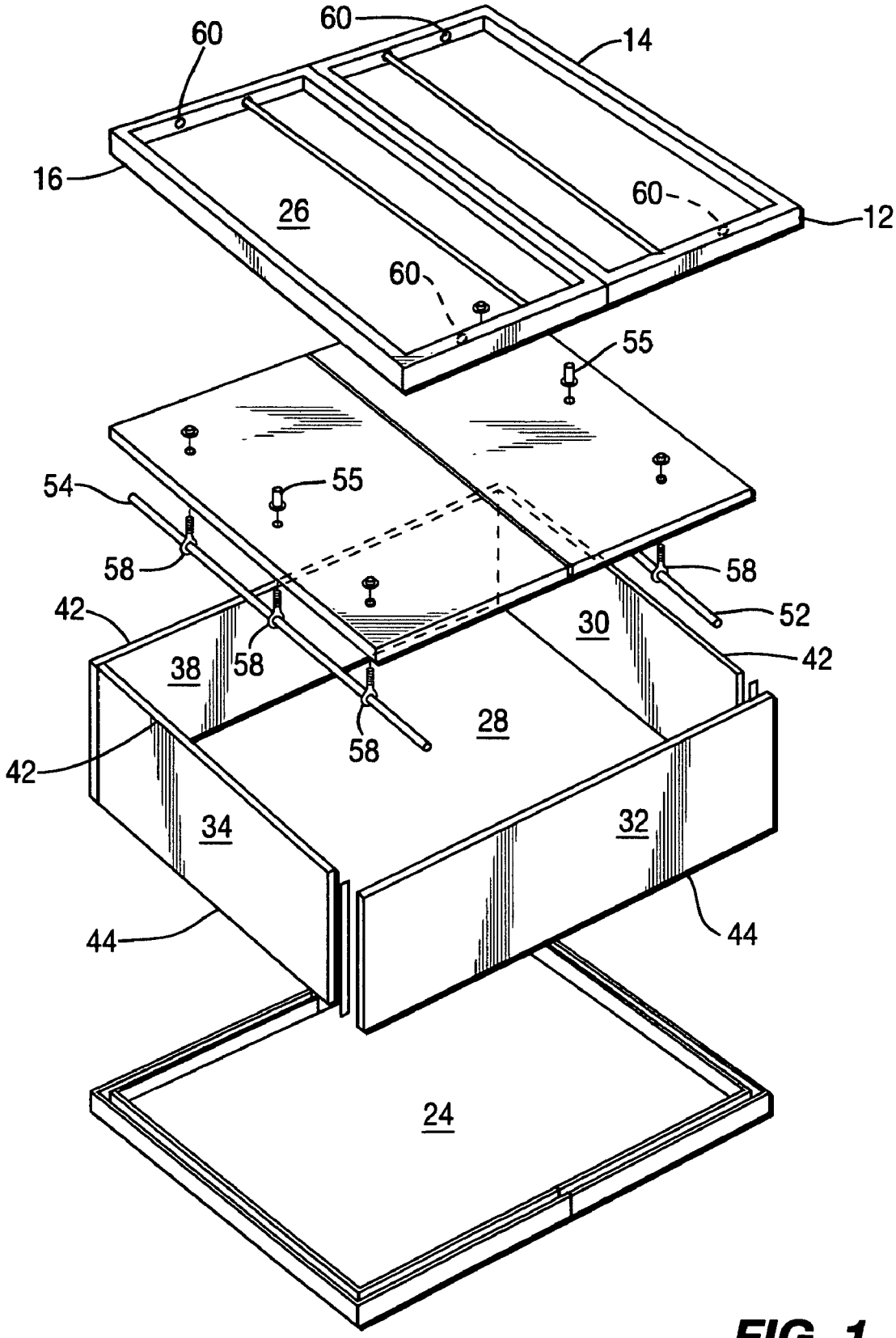
FIG. 1 is an assembly view of an embodiment of the insulated housing apparatus of the present invention.

The present invention provides an enclosure adapted to extend about a fan 10 which is normally positioned adjacent to environmental structure such as the ceiling of a living area. Such fans are commonly used for exhausting such as when utilized as attic fans 10 and are positioned in the uppermost ceiling in the uppermost floor of a residence or commercial building living area to facilitate exhausting of hot air therefrom particularly during warm seasons. This air movement is further enhanced because such hot air tends to rise.

A major problem occurs in regard to the opening in that these attic fans 10 are positioned within in the environment structural 11 which needs to be sealed to prevent air flow therethrough whenever the fan is not operating. For this purpose the present invention defines an enclosure formed by an upper frame 12 and a lower frame 18.

In this embodiment the upper frame 12 and the lower frame 18 are generally each chosen to be generally rectangularly shaped and are spatially positioned with respect to one another to define a fan containment chamber 74 therebetween. A plurality of individual insulating panels extend therebetween to preferably form an overall rectangular configuration. These insulating panel members include a first insulating panel member 30, a second insulating panel member 32, a third insulating panel member 34 and a fourth insulating panel member 38. These panels extend vertically between the upper frame 12 and the lower frame 18 for defining an overall box-like rectangular or square configuration defining the fan containment chamber 74 therewithin.

The upper frame 12 preferably includes a first upper frame member 14 and a second upper frame member 16 detachably securable with respect to one another and defining therethrough an air outlet aperture 26. The first upper frame member 14 preferably defines a first upper frame member engagement channel 15 which is capable of receiving portions of the upper edge zone 42 of the insulating panels 30, 32, 34 and 38 thereinto to facilitate engagement therewith. Similarly the second upper frame member 16 defines a second upper frame engagement channel 17 therein which is defined to receive portions of the upper edges of any of the insulating panels 30, 32, 34 or 38 extending thereinto for facilitating engagement therewith.

The lower frame means 18 can preferably include a first lower frame member 19 and a second lower frame member 21. First lower frame member 19 preferably defines a first lower frame member engagement channel 20 defined therein to facilitate engagement with at least a portion of the lower edge zone 44 of the insulating panels 30, 32, 34 and 38 to facilitate securement between these panels and the lower frame means 18. The lower frame means 18 including both the first lower frame member 19 and the second lower frame member 21 will preferably include concave engagement channels therein. In particular the first lower frame member 19 will preferably be of a concave cross-section and will define a first lower frame engagement channel 20 therein to facilitate engagement with to at least a portion of the lower edge zones 44 of the individual panels 30, 32, 34 and 38. Similarly, the second lower frame member 21 will preferably be of a concave cross-section and will include a second lower frame member engagement channel 22 to facilitate engagement thereof with respect at least a portion of the lower edge zone 44 of the panels 30, 32, 34 and 38.

The upper frame means 12 is formed by engagement between the first upper frame member 14 and the second upper frame member 16 which can be achieved by engaging the panels with members 14 and 16 when they are placed adjacent to one another.

Lower locking blocks 67 can be utilized extending into the first lower frame member engagement channel 20 and the second lower frame member engagement channel 22 to facilitate engagement between the first lower frame engagement channel 20 and the second lower frame engagement channel 22. In this manner the lower frame means 18 is formed by engagement between the first lower frame member 19 and the second lower frame member 21. In an alternative configuration, engagement between the lower frame members can be achieved by use of locking sleeves 68 which are adapted to extend around the outside of adjacent portions of adjacently positioned frame sections. The locking sleeves 68 or the locking blocks 66 and 67 can either be utilized with a set screw 70 such as thumb screws to facilitate securement between each pair of sections of the lower frame. With this configuration, the exhaust fan insulated enclosure apparatus of the present invention defines an enclosure with a fan containment chamber 74 therewithin which can be easily sealed whenever the fan is not operating. However, when the attic fan is operated, the upper doors will automatically open allowing air to enter the insulated enclosure through the air intake aperture 24 defined within the lower frame 18 and pass inwardly into the air flow conduit 28 or fan containment chamber 74 defined within the four panels 30, 32, 34 and 38. The air will then pass further upwardly through the air outlet aperture 26 and be vented upwardly in a standard manner as desired.

To selectively close the air outlet aperture 26 and thereby prevent air from flowing through the air flow conduit 28, upper door means 46 are included in the apparatus of the present invention. This upper door means preferably includes two pivotally doors, namely, namely a first door member 48 and a second door member 50. Each of these members is defined to extend over approximately half of the upper outlet aperture 26.

The first door member 48 is pivotally secured with respect to the first upper frame member 14 such as to normally be positioned extending thereover in a closed position but being operative to move to an opened position extending angularly upwardly responsive to actuation of the fan 10. First door member 48 preferably includes a first pivot axle means 52 mounted adjacent the lower surface thereof to facilitate this pivotal movement between the generally horizontally oriented closed position and the generally upwardly inclined opened position. The first pivot axle 52 preferably will extend outwardly on each end beyond the edges of the upper door 46 into first axle holes 60 defined on the interior portion of the first upper frame member 14. These axle holes or first axle apertures 60 will be loosely mounted with respect to the first pivot axle means 52 such that the panel secured to the aperture can be pivotally movable axially with respect thereto.

The second door member 50 will be similarly configured such as to include a second pivot axle means 54 to allow the second door member 50 to move between a closed position extending over the second upper frame member 16 and an opened position allowing air flow therethrough. The second pivot axle 54 will be pivotally mounted with respect to second axle apertures 61 defined in the inner edges of the second upper frame member 16.

Figure 7:
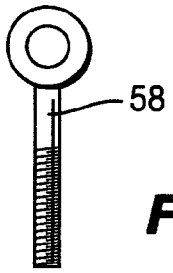
FIG. 7 is a side plan view of an embodiment of an axle holding eyelet bolt usable with the present invention.
Figure 10:
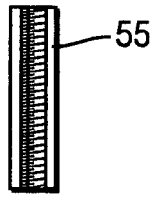
FIG. 10 is a cross-sectional view of an embodiment of the limit pin mounting sleeve having a threaded interior corridor to facilitate mounting.
Figure 8:
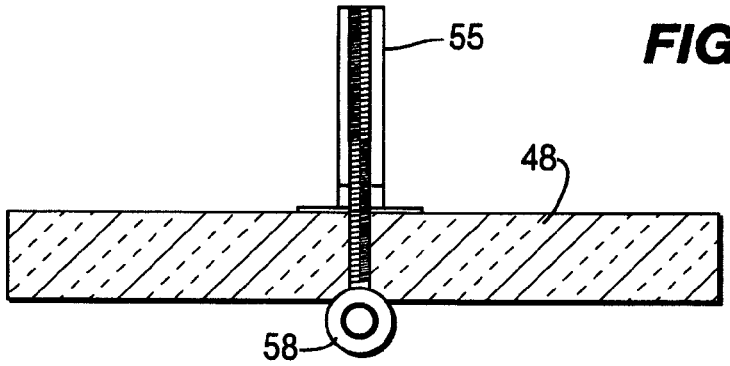
FIG. 8 is a front cross-sectional view of an embodiment of the axle holding means of the present invention.
Figure 9:
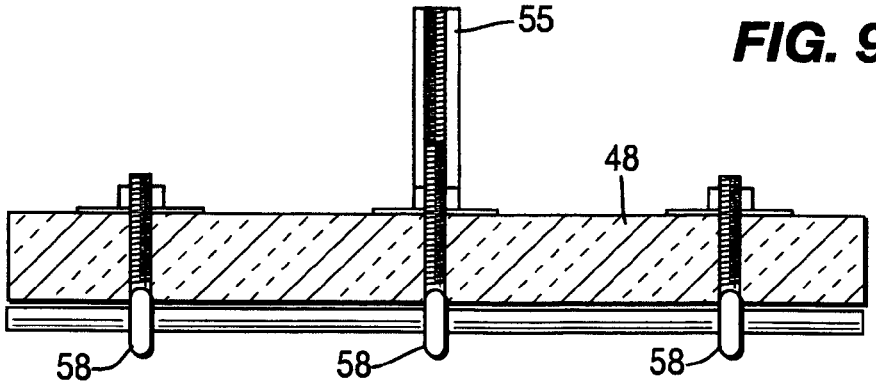
FIG. 9 is a side cross-sectional view of the axle holding means of the present invention.

A preferred configuration of the present device includes axle holding pins 58 such as eyelet bolts which are positioned to extend through the first door and the second door at locations along the position of securement of the respective axle thereto. These axle holding pins 58 preferably include axle holders which have holes defined therein through which the axle extends. These axle holding pins 58 can be of various configurations such as the eye bolts 62 shown in FIGS. 7,8 and 9. These devices extend through the door and define axial openings corresponding to the axial orientation of the individual axles to facilitate positioning of the axles therewithin and securement of the axles to the respective doors. It should be appreciated that the axle holding pin 58 will usually be configured as eye bolts 62.

Figure 6:
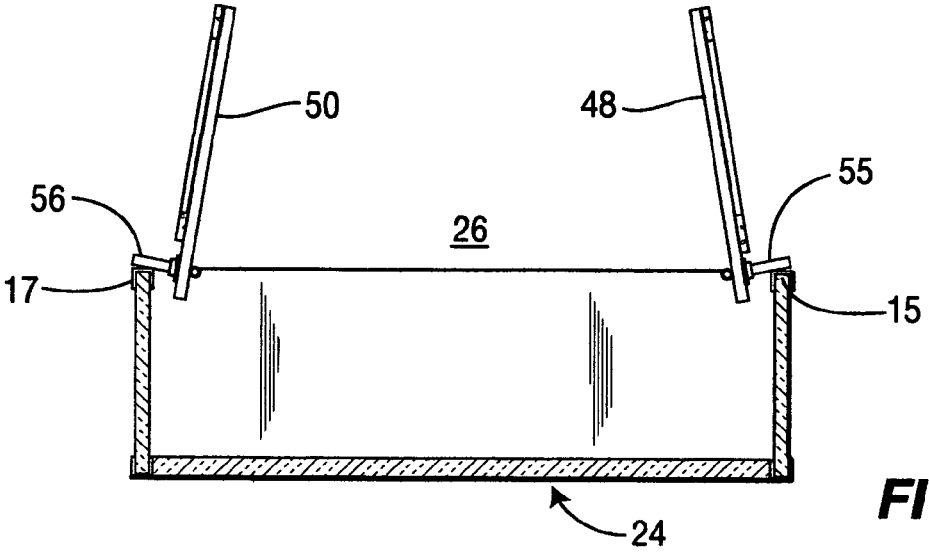
FIG. 6 is a side cross-sectional view of an embodiment of the present invention shown in the maximum opened position with the stop means in engagement with the upper frame.

Also in a preferred configuration abutment members or stops can be included secured to the at least one of the axle holding pins 58 or eye bolts 62 on each door 48 and 50 and extending further outwardly therefrom on the side of the door opposite from the axle to provide a stop means for limiting the extent of total movement of the adjacent door toward the opened position. As shown in FIG. 6, the first abutment member or first limit pin 55 limits the total outward movement of the first door member 48 toward the opened position. In a similar manner the second abutment member or limit pin 56 limits the total extent of opening movement of the second door member 50 toward the opened position. As seen best in FIG. 6 these limit pins 55 and 56 will prevent the doors 48 and 50, respectively, from moving to an overextended opened position thereby assuring that both doors will return to the generally horizontally oriented closed position after operation of the exhaust fan 10 ceases. Thus, when the movement of air by the fan ceases, gravitational forces will urge these doors to fall downwardly to the closed position. Thus, the doors will automatically be blown to the opened position when the fan starts operating and will fall by gravitational force to the closed position when the fan stops operating. As such, this design provides a means for automatically opening and closing the doors in order to insulate the attic fan and adjacent attic fan opening. This automatic means of operation uses very little energy itself and greatly saves energy by preventing heating loss through an attic fan ceiling opening whenever the exhaust fan is not running.

It should be appreciated that the top frame and the bottom frame can be constructed of any rigid material such as wood, metal or plastic to form the capability of pivotal movement. It is preferable that the frames are formed of a lightweight sheet metal or possibly plastic to facilitate movement and to minimize cost and weight thereof. It is also preferable that the device of the present invention is fully collapsible to facilitate disassembly and storage in very small areas. Preferably the panels 30, 32, 34 and 38 are formed of an insulating material such as styrofoam.

Figure 2:
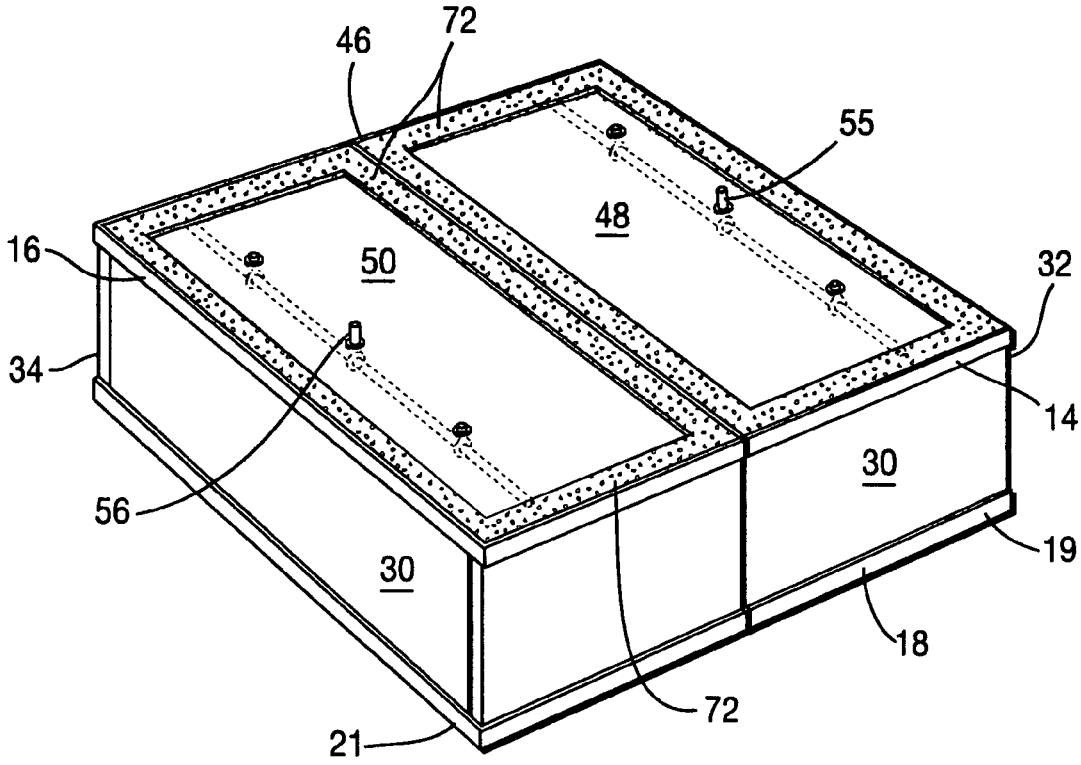
FIG. 2 is a perspective illustration of an embodiment of the insulated housing apparatus shown in the closed position.
Figure 3:
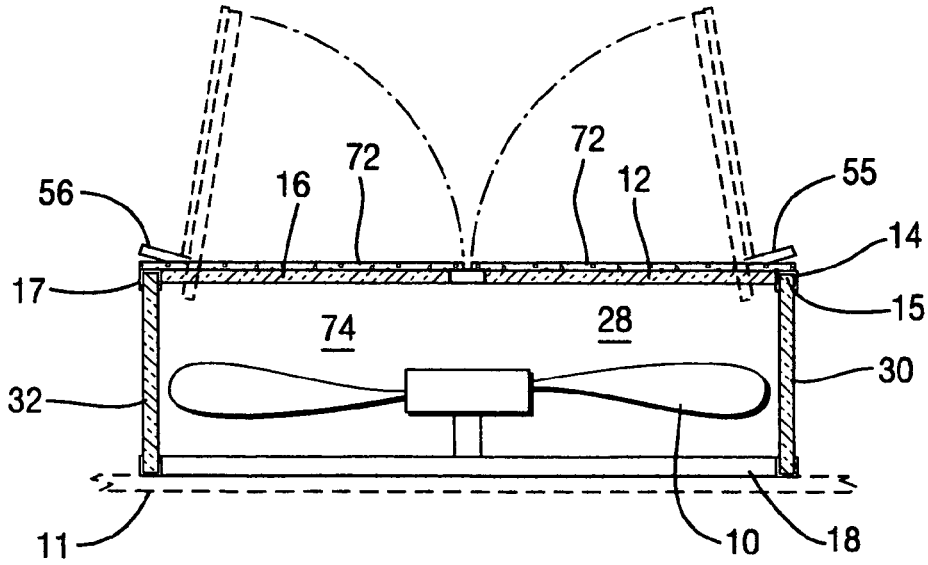
FIG. 3 is a side cross-sectional view of an embodiment of the apparatus of the present invention shown in the opened position.
Figure 4:
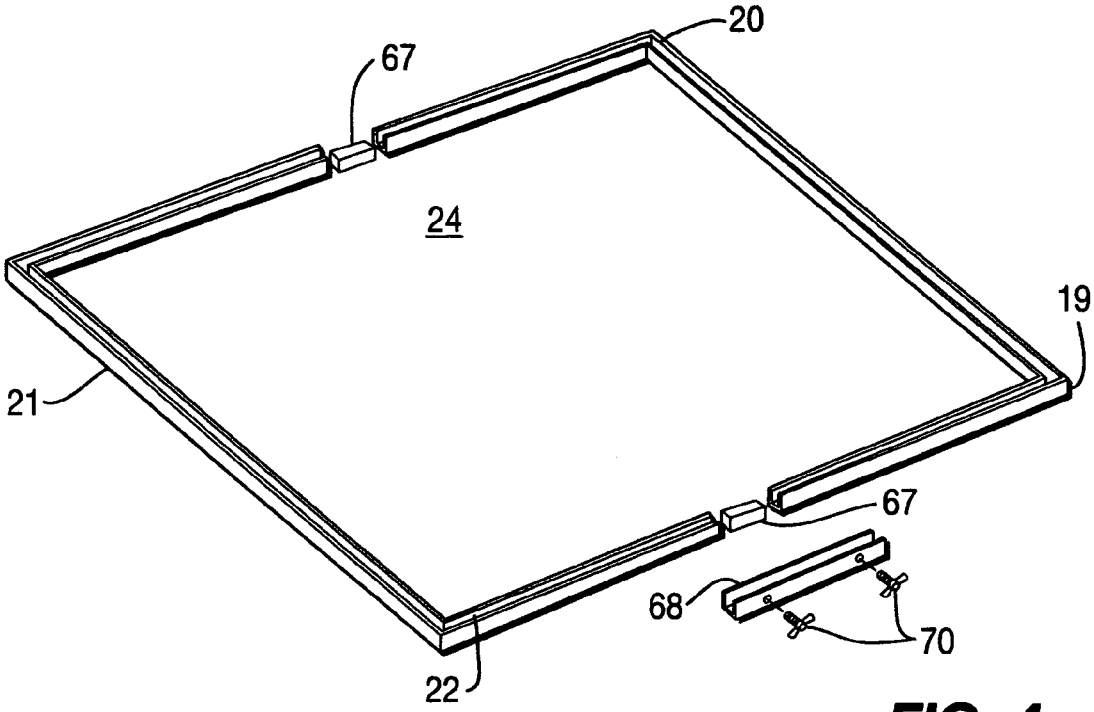
FIG. 4 is an assembly view of an embodiment of the lower frame construction of the present invention.
Figure 5:
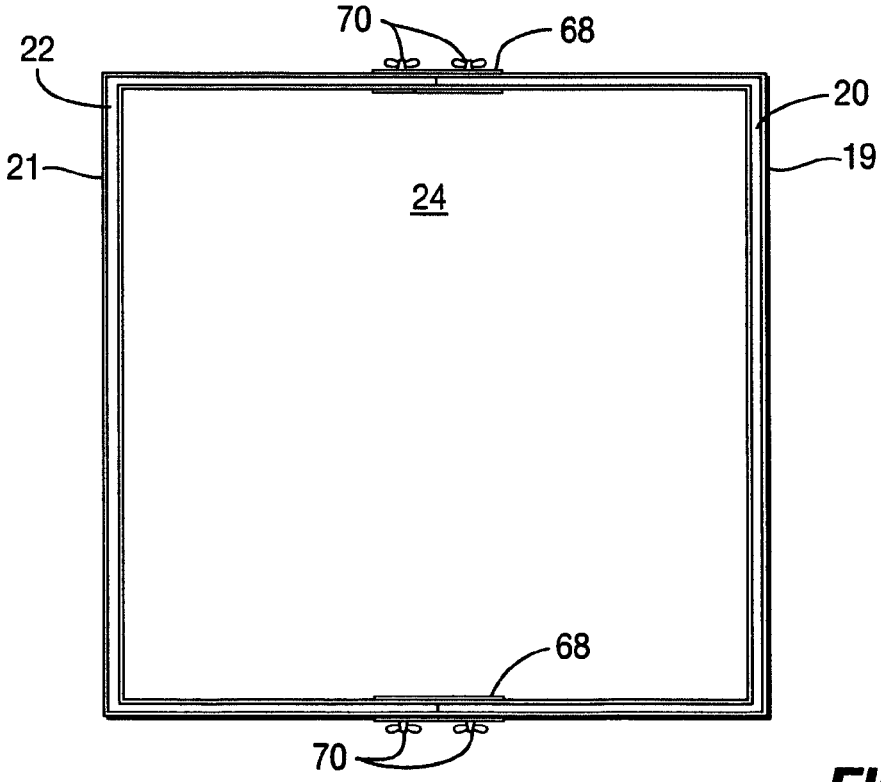
FIG. 5 is a top plan view of the lower frame embodiment shown in FIG. 4.

Another preferred configuration of the present invention is the inclusion of gaskets or sealing members 72 as shown best in FIGS. 2 and 3 which extend along the upper edges of the first and second door members 48 and 50 to effectively seal therearound to minimize leakage therepast. These gaskets can extend outwardly beyond the edges of the doors to facilitate overlapping engagement and sealing between the doors themselves and between the doors and the upper frame means 12.

In the preferred configuration of the present invention, each door will include several axle holding means 58 preferably in the form of eye bolts extending therethrough and engaging the respective axle for mounting thereof relative to the respective door. Preferably at least one of the eye bolts utilized on each door will include a mounting sleeve or tube secured to the end thereof to provide the outwardly extending first and second abutment stops 55 and 56 with one mounted on each door. In this manner control of the extent of movement of doors 48 and 50 away from the closed position will be limited to thereby assure that they will both return to the closed position whenever the attic fan ceases operation.

To further facilitate sealing of the air outlet aperture 26, the first door 48 will define a first door outermost edge 76. Similarly the second door member 50 will define a second door outermost edge 78. Edge 76 will be caused to abut edge 78 responsive to both the first door member 48 and the second door member 50 being positioned in the closed position to further facilitate sealing of air outlet aperture 26.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intend to be illustrative only and not intended to limit the scope of the invention.

I claim:

1. An insulated housing apparatus for receiving an exhaust fan mounted therewith which comprises:

A. a housing means defining a fan containment chamber means therewith adapted to receive an exhaust fan positioned therewithin, said housing means further defining an air intake aperture means and an air outlet aperture means positioned spatially displaced from one another within said housing means, said housing means further including;

(1) a first upper frame member;

(2) a second upper frame member being engageable with respect to said first upper frame member to define therebetween said air outlet aperture means within said housing means;

(3) a first lower frame member being generally U-shaped;

(4) a second lower frame member being generally U-shaped and being engageable with respect to said first lower frame member to define therebetween said air inlet aperture means within said housing means;

B. a first door member pivotally mounted with respect to said first upper frame member of said housing means and pivotally movable between a steady state closed position extending across said first upper frame member for facilitating closing of said air outlet aperture means and pivotally movable to an opened position extending away from said air outlet aperture means to facilitate allowing air to exit therethrough;

C. a second door member pivotally mounted with respect to said second upper frame member of said housing means and pivotally movable between a steady state closed position extending across said second upper frame member for facilitating closing of said air outlet aperture means and pivotally movable to an opened position extending away from said air outlet aperture means to facilitate allowing air to exit therethrough, said first door member and said second door member being normally positioned in a steady state position extending across said air outlet aperture means toward one another for closing thereof and preventing air flow therethrough, said first door member and said second door member being pivotally movable to a opened position extending away from said air outlet aperture means to allow air to exit therethrough responsive to operation of the exhaust fan positioned within said fan containment chamber means;

D. a first limit pin means secured to said first door member and positioned extending outwardly thereof and being movable along with said first door member into abutment with respect to said first upper frame member responsive to pivotal movement of said first door member to the opened position to limit the total amount of pivotal movement of said first door member from the closed position to the opened position; and E. a second limit pin means secured to said second door member and positioned extending outwardly thereof and being movable along with said second door member into abutment with respect to said second upper frame member responsive to pivotal movement of said second door member to the opened position to limit the total amount of pivotal movement of said second door member from the closed position to the opened position.

2. An insulated housing apparatus for receiving an exhaust fan mounted therewith as defined in claim 1 wherein said first limit pin means limits the total movement of said first door member to less than ninety degrees between the closed position and the opened position thereof to facilitate return of said first door member to the closed position responsive to cessation of operation of the exhaust fan and wherein said second limit pin means limits the total movement of said second door member to less than ninety degrees between the closed position and the opened position thereof to facilitate return of said second door member to the closed position responsive to cessation of operation of the exhaust fan.

3. An insulated housing apparatus for receiving an exhaust fan mounted therewith as defined in claim 1 wherein said first limit pin means is oriented approximately perpendicularly with respect to said first door member and wherein said second limit pin means is oriented approximately perpendicularly with respect to said second door member.

4. An insulated housing apparatus for receiving an exhaust fan mounted therewith as defined in claim 1 wherein said first limit pin means can be bent in order to adjust the opened position of said first door member and wherein said second limit pin means can be bent in order to adjust the opened position of said second door member.

5. An insulated housing apparatus for receiving an exhaust fan mounted therewith as defined in claim 1 wherein said first door means includes a first door outermost edge and said second door means includes a second door outermost edge which will be caused to move into abutting engagement with respect to one another responsive to movement of said first door member and said second door member to the closed position to facilitate sealing of said outer aperture means responsive to cessation of operation of an exhaust fan positioned within said fan containment chamber means.

6. An insulated housing apparatus for receiving an exhaust fan mounted therewith as defined in claim 1 wherein said housing means further includes an insulating panel means extending from said first upper frame member and said second upper frame member to said first lower frame member and said second lower frame member to facilitating defining of said fan containment chamber means therewithin.

7. An insulated housing apparatus for receiving an exhaust fan mounted therewith as defined in claim 6 wherein said insulating panel means comprises:

A. a first insulating panel mountable to and extending between said first lower frame member and said first upper frame member;

B. a second insulating panel mountable to and extending between said second lower frame member and said second upper frame member;

C. a third insulating panel means mountable to said first upper frame member and said upper second frame member and extendable downwardly therefrom to be also mountable to said first lower frame member and said second upper frame member; and D. a fourth insulating panel means mountable to said first upper frame member and said upper second frame member at a position spatially disposed from said third insulating panel means and extendable downwardly therefrom to be also mountable to said first lower frame member and said second upper frame member at a position spatially disposed from said third insulating panel means.

8. An insulated housing apparatus for receiving an exhaust fan mounted therewith as defined in claim 6 wherein said first upper frame member defines a first upper engagement channel means therewithin to facilitate engagement with respect to said panel insulation means, and wherein said second upper frame member defines a second upper engagement channel means therewithin to facilitate engagement with respect to said panel insulation means.

9. An insulated housing apparatus for receiving an exhaust fan mounted therewith as defined in claim 8 wherein said first lower frame member defines a first lower engagement channel means therewithin to facilitate engagement with respect to said panel insulation means and engagement with respect to said second lower frame member, and wherein said second lower frame member defines a second lower engagement channel means therewithin to facilitate engagement with respect to said panel insulation means and engagement with respect to said first lower frame member.

10. An insulated housing apparatus for receiving an exhaust fan mounted therewith as defined in claim 9 further including a lower locking block means positionable within said first lower engagement channel means and said second lower engagement channel means to detachably interlock said first lower frame member with respect to said second lower frame member.

11. An insulated housing apparatus for receiving an exhaust fan mounted therewith as defined in claim 1 wherein said first upper frame member defines a plurality of first axle apertures therewithin adjacent said air outlet aperture means and wherein said first door member includes a first pivot axle means mounted thereto which is positionable extending into said first axle apertures in said first upper frame member to facilitate pivotal movement of said first door member between the closed position and the opened position, respectively.

12. An insulated housing apparatus for receiving an exhaust fan mounted therewith as defined in claim 11 wherein said first door member includes at least one first door securement stud mounted thereto which is engageable with respect to said first pivot axle means to facilitate securement thereof with respect to said first door member, said first door securement stud extending completely through said first door member to provide said first limit pin means extending outwardly therefrom.

13. An insulated housing apparatus for receiving an exhaust fan mounted therewith as defined in claim 12 wherein said first door securement stud comprises a first door eyelet bolt to facilitate mounting of said first pivot axle means with respect to said first door member.

14. An insulated housing apparatus for receiving an exhaust fan mounted therewith as defined in claim 1 wherein said second upper frame member defines a plurality of second axle apertures therewithin adjacent said air outlet aperture means and wherein said second door member includes a second pivot axle means mounted thereto which is positionable extending into said second axle apertures in said second upper frame member to facilitate pivotal movement of said second door member between the closed position and the opened position, respectively.

15. An insulated housing apparatus for receiving an exhaust fan mounted therewith as defined in claim 14 wherein said second door member includes at least one second door securement stud mounted thereto which is engageable with respect to said second pivot axle means to facilitate securement thereof with respect to said second door member, said second door securement stud extending completely though said first door member to provide said second limit pin means extending outwardly therefrom.

16. An insulated housing apparatus for receiving an exhaust fan mounted therewith as defined in claim 15 wherein said second door securement stud comprises a second door eyelet bolt to facilitate mounting of said second pivot axle means with respect to said second door member.

17. An insulated housing apparatus for receiving an exhaust fan mounted therewith as defined in claim 1 further comprising a first gasket means secured to said first door means and extending at least partially peripherally therearound to facilitate sealing of said air outlet aperture means responsive to positioning of said first door member in the closed position.

18. An insulated housing apparatus for receiving an exhaust fan mounted therewith as defined in claim 1 further comprising a second gasket means secured to said second door means and extending at least partially peripherally therearound to facilitate sealing of said air outlet aperture means responsive to positioning of said second door member in the closed position.

19. An insulated housing apparatus for receiving an exhaust fan mounted therewith which comprises:

A. a housing means defining a fan containment chamber means therewith adapted to receive an exhaust fan positioned therewithin, said housing means further defining an air intake aperture means and an air outlet aperture means positioned spatially displaced from one another within said housing means, said housing means further including;

(1) a first upper frame member defining a first upper engagement channel means therewithin, said first upper frame member defining a plurality of first axle apertures therewithin adjacent said air outlet aperture means;

(2) a second upper frame member engageable with respect to said first upper frame member to define therebetween said air outlet aperture means within said housing means, said second upper frame member defining a second upper engagement channel means therewithin, said second upper frame member defining a plurality of second axle apertures therewithin adjacent said air outlet aperture means;

(3) a first lower frame member being generally U-shaped and defining a first lower engagement channel means therewithin;

(4) a second lower frame member being generally U-shaped and being engageable with respect to said first lower frame member to define therebetween said air inlet aperture means within said housing means and defining a second lower engagement channel means therewithin;

(5) a plurality of insulating panel means extending from said first upper frame member and said second upper frame member to said first lower frame member and said second lower frame member to facilitating defining of said fan containment chamber means therewithin, said insulation panel means adapted to extending selectively into said first upper engagement channel means and into said second upper engagement channel means and into said first lower engagement channel means and into said second lower engagement channel means to facilitate engagement therebetween;

B. a first door member pivotally mounted with respect to said first upper frame member of said housing means and pivotally movable between a steady state closed position extending across said first upper frame member for facilitating closing of said air outlet aperture means and pivotally movable to an opened position extending away from said air outlet aperture means to facilitate allowing air to exit therethrough;

C. a second door member pivotally mounted with respect to said second upper frame member of said housing means and pivotally movable between a steady state closed position extending across said second upper frame member for facilitating closing of said air outlet aperture means and pivotally movable to an opened position extending away from said air outlet aperture means to facilitate allowing air to exit therethrough, said first door member and said second door member being normally positioned in a steady state position extending across said air outlet aperture means toward one another for closing thereof and preventing air flow therethrough, said first door member and said second door member being pivotally movable to a opened position extending away from said air outlet aperture means to allow air to exit therethrough responsive to operation of the exhaust fan positioned within said fan containment chamber means;

D. a first limit pin means secured to said first door member and positioned extending outwardly thereof and being movable along with said first door member into abutment with respect to said first upper frame member responsive to pivotal movement of said first door member to the opened position to limit the total amount of pivotal movement of said first door member from the closed position to the opened position, said first limit pin means limiting the total movement of said first door member to less than ninety degrees between the closed position and the opened position thereof to facilitate return of said first door member to the closed position responsive to cessation of operation of the exhaust fan;

E. a second limit pin means secured to said second door member and positioned extending outwardly thereof and being movable along with said second door member into abutment with respect to said second upper frame member responsive to pivotal movement of said second door member to the opened position to limit the total amount of pivotal movement of said second door member from the closed position to the opened position, said second limit pin means limiting the total movement of said second door member to less than ninety degrees between the closed position and the opened position thereof to facilitate return of said second door member to the closed position responsive to cessation of operation of the exhaust fan;

F. a lower locking block means positionable within said first lower engagement channel means and said second lower engagement channel means to detachably interlock said first lower frame member with respect to said second lower frame member;

G. a first pivot axle means mounted to said first door member and being positionable extending into said first axle apertures in said first upper frame member to facilitate pivotal movement of said first door member between the closed position and the opened position, respectively;

H. a second pivot axle means mounted to said second door member and being positionable extending into said second axle apertures in said second upper frame member to facilitate pivotal movement of said second door member between the closed position and the opened position, respectively;

I. a first gasket means secured to said first door means and extending at least partially peripherally therearound to facilitate sealing of said air outlet aperture means responsive to positioning of said first door member in the closed position; and J. a second gasket means secured to said second door means and extending at least partially peripherally therearound to facilitate sealing of said air outlet aperture means responsive to positioning of said second door member in the closed position.

20. An insulated housing apparatus for receiving an exhaust fan mounted therewith which comprises:

A. a housing means defining a fan containment chamber means therewith adapted to receive an exhaust fan positioned therewithin, said housing means further defining an air intake aperture means and an air outlet aperture means positioned spatially displaced from one another within said housing means, said housing means further including;

(1) a first upper frame member;

(2) a second upper frame member being engageable with respect to said first upper frame member to define therebetween said air outlet aperture means within said housing means;

B. a first door member pivotally mounted with respect to said first upper frame member of said housing means and pivotally movable between a steady state closed position extending across said first upper frame member for facilitating closing of said air outlet aperture means and pivotally movable to an opened position extending away from said air outlet aperture means to facilitate allowing air to exit therethrough;

C. a second door member pivotally mounted with respect to said second upper frame member of said housing means and pivotally movable between a steady state closed position extending across said second upper frame member for facilitating closing of said air outlet aperture means and pivotally movable to an opened position extending away from said air outlet aperture means to facilitate allowing air to exit therethrough, said first door member and said second door member being normally positioned in a steady state position extending across said air outlet aperture means toward one another for closing thereof and preventing air flow therethrough, said first door member and said second door member being pivotally movable to a opened position extending away from said air outlet aperture means to allow air to exit therethrough responsive to operation of the exhaust fan positioned within said fan containment chamber means;

D. a first limit pin means secured to said first door member and positioned extending outwardly thereof and being movable along with said first door member into abutment with respect to said first upper frame member responsive to pivotal movement of said first door member to the opened position to limit the total amount of pivotal movement of said first door member from the closed position to the opened position, said first limit pin means being capable of being bent in order to adjust the opened position of said first door member; and E. a second limit pin means secured to said second door member and positioned extending outwardly thereof and being movable along with said second door member into abutment with respect to said second upper frame member responsive to pivotal movement of said second door member to the opened position to limit the total amount of pivotal movement of said second door member from the closed position to the opened position, said second limit pin means being capable of being bent in order to adjust the opened position of said second door member.

* * * * *